US006360983B1

(12) United States Patent
Pumpe

(10) Patent No.: US 6,360,983 B1
(45) Date of Patent: Mar. 26, 2002

(54) REEL WINDING DEVICE AND PROCESS FOR SUPPORTING A WINDING REEL

(75) Inventor: Rainer Pumpe, Krefeld (DE)

(73) Assignee: Voith Sulzer Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/391,351

(22) Filed: Sep. 8, 1999

(30) Foreign Application Priority Data

Sep. 15, 1998 (DE) ..... 198 42 188

(51) Int. Cl.[7] ..... B65H 18/14; B65H 26/02
(52) U.S. Cl. ..... 242/542; 242/534; 242/595.1
(58) Field of Search ..... 242/595.1, 541.4, 242/542, 534, 541.7

(56) References Cited

U.S. PATENT DOCUMENTS

| | | | | |
|---|---|---|---|---|
| 3,004,728 A | * | 10/1961 | Ihle | 242/534 |
| 3,497,151 A | * | 2/1970 | Voss et al. | 242/541.7 |
| 4,420,124 A | * | 12/1983 | Bardsley et al. | 242/532 |
| 5,478,026 A | * | 12/1995 | Schönmeier et al. | 242/542 |
| 5,505,403 A | | 4/1996 | Raudaskoski | |
| 5,562,261 A | | 10/1996 | Beisswanger et al. | |
| 5,820,063 A | | 10/1998 | Fissman et al. | |
| 5,823,463 A | * | 10/1998 | Fisemann et al. | 242/541.7 |
| 5,829,709 A | | 11/1998 | Dorfel | |
| 5,839,689 A | * | 11/1998 | Krüger et al. | 242/542 |
| 5,848,760 A | | 12/1998 | Krüger et al. | |
| 5,899,405 A | | 5/1999 | Kruger et al. | |
| 5,924,647 A | | 7/1999 | Doefel | |

FOREIGN PATENT DOCUMENTS

| | | |
|---|---|---|
| CA | 2141467 | 8/1995 |
| CA | 2199402 | 3/1996 |
| CA | 2188340 | 4/1997 |
| CA | 2188342 | 4/1997 |
| CA | 2197597 | 8/1997 |
| CA | 2208328 | 12/1997 |
| DE | 195 38 973 | 4/1987 |
| DE | 4402624 | 6/1994 |
| DE | 9414449 | 2/1996 |
| DE | 19624716 | 11/1996 |
| DE | 195 24 905 | 1/1997 |
| DE | 197 09 325 | 9/1998 |
| EP | 631955 | 1/1995 |
| EP | 631956 | 1/1995 |
| EP | 769464 | 4/1997 |
| EP | 769465 | 4/1997 |
| EP | 791549 | 8/1997 |

OTHER PUBLICATIONS

English Language Abstract of DE 19538973.
English Language Abstract of DE 19709325.

* cited by examiner

*Primary Examiner*—Michael R. Mansen
(74) *Attorney, Agent, or Firm*—Greenblum & Bernstein, P.L.C.

(57) ABSTRACT

Reel winding device and process for supporting a reel winding device. The device includes a winding bed formed from two support rolls, that form side walls of a pressure chamber, and a bottom wall having at least one movable sealing member disposed between the bottom wall and at least one support wall. The movable member is adapted to move in a direction away from the winding bed and may be loaded with a positioning force in the direction of a sealing position. The movable member cooperates with a position sensor, which emits an error signal in the event of displacement of the sealing body away from the support roll. The process includes rotating the winding reel, rotating the support rolls and positioning a movable sealing body in a vicinity of a circumferential surface of at least one support roll. The process further includes moving the sealing body in a direction away from the winding bed and loading the sealing body with a positioning force in the direction of a sealing position. The process also includes the movable body cooperating with a position sensor, which emits an error signal in the event of a displacement of the sealing body away from the support roll.

32 Claims, 4 Drawing Sheets

REEL WINDING DEVICE AND PROCESS FOR SUPPORTING A WINDING REEL

CROSS-REFERENCE TO RELATED APPLICATIONS

The present application claims priority under 35 U.S.C. §119 of German Patent Application No.198 42 188.5, filed on Sep. 15, 1998, the disclosure of which is expressly incorporated by reference herein in its entirety.

BACKGROUND OF THE INVENTION

1. Field of the Invention

The invention concerns a reel winding device having a winding bed with two support rolls that form side walls of a pressure chamber which is also bounded by a bottom wall.

2. Discussion of Background Information

In one of the final production steps, paper webs are usually cut to the proper width and then wound into reels before being packaged and delivered. In contrast to the drums used during paper production, the winding cores onto which the paper reels are wound have only relatively slight rigidity and load-bearing capacity. They are often constructed, e.g., as cardboard tubes. This leads to the paper reels usually being supported during winding by supporting rolls. This occurs particularly when the winding device is structured as a support roll winding machine. Here, the reel lies on support rolls without additional holding forces gripping the core. But even with a support roll winder, in which additional holding elements grip the reel core, the reel is supported on a roll. When the paper reels become larger and heavier, the linear support forces of the paper reel become relatively large on the support roll or rolls, which has the disadvantage of increasing the winding tightness. This can lead to a subsequent failure in the winding structure of the roll. To relieve the pressure on the reels and to reduce the linear force, a pneumatic overpressure can be generated under the reel so that at least part of the reel weight is supported by an air cushion.

The air cushion is generated in the pressure chamber. The pressure chamber is bounded on the left and on the right by the two support rolls, by the winding reel on the top, and by the bottom wall on the bottom. Additional sealing measures, which are, however, of secondary importance for the present invention, are provided for the ends. During operation, the bottom wall should move as close as possible to the support rolls. If the material web enters the winding bed from below, it is not desirable for the bottom wall to touch the material web. However, a sliding contact with the other support roll which is not surrounded by the material web may be permitted if the surface of the bottom wall is appropriately structured. In most cases, however, a small gap is permitted with two support rolls.

However, the requirement that the bottom wall be as close as possible to the support rolls makes handling of the reel winding device more difficult when a new material web is to be introduced into the winding bed. This is nonetheless essential from time to time, for example, after a web break. The threading of the material web into the narrow gap between the corresponding support roll and the bottom wall takes a relatively long time. In the event of a web break, a paper jam, which can only be removed with great effort, may occur in the pressure chamber. In the worst case, it can even cause destruction of the seals or of the support roll.

DE 195 24 905 A1 proposes placing the bottom wall, which is structured as a sealed box, on a movable carrier. In other words, the bottom wall is completely pivotable from its operating position into a resting position.

However, this procedure requires a significant design outlay. Normally, the bottom wall must cover the entire axial length of the winding device. This is usually the working width of an upstream paper machine and may be as much as 10 meters. This design makes it difficult to maintain a constant sealing gap between the support rolls and the bottom wall. The application and retraction of the bottom is relatively expensive since large masses must be moved.

SUMMARY OF THE INVENTION

The present invention provides for a reel winding device which includes a winding bed composed of two support rolls that form side walls of a pressure chamber, and a bottom wall having at least one movable sealing body disposed between the bottom wall and at least one support roll. In the device, at least one movable sealing body is adapted to move in a direction away from the winding bed and may be loaded with a positioning force, such as a force spring, in the direction of a sealing position or may be loaded with a path-length independent force from a positioning motor. The positioning force may be substantially in equilibrium with the sum of the weight of the sealing body and a force resulting from a compressed air load. The at least one movable sealing body may work in cooperation with a stop motion device and/or with a position sensor, which emits an error signal in the event of a displacement of the sealing body away from the support roll.

In another embodiment, the at least one movable sealing body contacting the support roll may be a sealing edge, which may also be movable along a plane which is sloped relative to a perpendicular mid-plane through the winding bed. The bottom wall of the device may be sloped in the direction toward the sealing body. The device may further include a stationary seal disposed between the bottom wall and one support roll, such that the direction of rotation of the one support roll runs from the bottom wall to the winding bed.

The present invention provides for a process for supporting a winding reel on an apparatus that includes a winding bed formed by two support rolls that form side walls of a pressure chamber, and a bottom wall having at least one movable sealing body disposed between the bottom wall and at least one support roll, the process including: rotating the winding reel, rotating the support rolls, and positioning the at least one movable sealing body in a vicinity of a circumferential surface of at least one support roll. The process further includes moving the at least one sealing body in a direction away from the winding bed. The process further includes loading the at least one movable sealing body with a positioning force, such as a spring force, in the direction of a sealing position or loading the at least one movable sealing body with a path-length independent force from a positioning motor. The positioning force may be substantially in equilibrium with the sum of the weight of the sealing body and a force resulting from a compressed air load. The at least one movable sealing body may cooperate with a stop motion device and/or with a position sensor, which emits an error signal in the event of a displacement of the sealing body away from the support roll.

In another embodiment, the at least one movable sealing body contacting the support roll may be a sealing edge, which may also move along a plane which is sloped relative to a perpendicular mid-plane through the winding bed. The bottom wall may be sloped in the direction toward the sealing edge. The process further includes disposing a stationary seal between the bottom wall and one support roll, such that the direction of rotation of the one support roll runs from the bottom wall to the winding bed.

The present invention is also concerned with simplifying handling in the zone of the seal, particularly in a reel winding device of this invention where a movable sealing body is disposed between the bottom wall and at least one support roll.

This has several advantages. The bottom wall can be structured as a "blow box", i.e., a body with a certain extension into the chamber, and can be disposed rigidly, i.e., immovable relative to the support rolls. Thus, the necessity of moving relatively large masses is avoided. The bottom wall can be positioned with relatively high precision relative to the support rolls. This position can be maintained during operation without the necessity of a complex structure. In addition, the shape of the bottom wall or of the blow box can also remain unchanged. For example, a normal rectangular profile with its shape-related stability is possible. Changes in the geometry are effected only by the sealing body or bodies. The sealing body is a separate component which can be inserted into the intermediate space between the support roll and the box with the bottom wall. The sealing body is a relatively lightweight component compared to the bottom wall. Since the box of the bottom wall can support the sealing body over the axial length of the support roll, i.e., parallel to the axis of rotation of the support roll, the sealing body need not have very great intrinsic stability. If an additional gap develops that needs to be sealed, i.e., a gap between the bottom wall and the sealing body, the air loss which can occur through the gap is offset by the advantages of the movable seal on the rigid and stationary bottom wall.

Advantageously, the sealing body is moveable away from the winding bed in one direction. Above all, this embodiment has an advantage if the material web breaks, as it often happens. If the material web breaks in the zone between the two support rolls, the material web is advanced into the winding bed without being picked up by the winding reel. A paper clog then develops, and it may result in damage to the support rolls and/or the bottom wall. But since the sealing body is moveable away from the winding bed, the sealing body moves away, thus permitting the paper web to escape from the zone between the support rolls.

Preferably, the sealing body is positioned with a positioning force in the direction of a sealing position. Thus, the sealing body is not rigidly or immovably fixed on the bottom wall, but rather is held in the desired position by a positioning force. If a force acts in the opposite direction such as that caused by incoming paper in the event of a malfunction, the sealing body is automatically pushed away and lets the paper clog pass through. The danger of damage is kept low.

It is also preferable that the positioning force be substantially in equilibrium with the sum of the weight of the sealing body and a force resulting from a compressed air load. The positioning force may in some instances be somewhat greater. When equilibrium exists, a small force is adequate to move the sealing body away from the support roll. Such a small force may arise if a malfunction occurs, thereby obviating the development of a greater problem. Even the threading of a product web is simpler if the web is introduced from below between the support rolls, since smaller forces are required to move the sealing body away from the support roll to provide the necessary manipulation space.

Preferably, the sealing body is spring-loaded. The spring thus presses the sealing body into its sealing position. This is a very simple and virtually maintenance-free embodiment.

In an alternative embodiment, the sealing body is loaded by a positioning motor with a force independent of the length of the path. The positioning motor can operate pneumatically, hydraulically, electrically, or magnetically. With this design, the force necessary to move the sealing body from the support roll does not increase with the increase in distance. Thus, the sealing body can free the entire opening when a malfunction occurs and before great counterforces develop.

In a preferred embodiment, provision is made for the sealing body to work in cooperation with a stop motion device. The stop motion device may be positioned, for example, on the bottom wall. With this design, it is possible for the sealing body to seal without contacting the support roll. The movement of the sealing body is limited in each case by a stop.

In an alternative embodiment, provision can be made for the sealing body to contact the support roll with a sealing edge. In this case, there is a contact seal. The thrust or the motion of the sealing body is not restricted until it contacts the support roll.

Preferably, the sealing body works in cooperation with a position sensor which emits an error signal if the sealing body is displaced from the support roll. The sensor can be structured as a movement or proximity switch. Thus, a controlled stopping of the winding device or even intentional cutting of the material web is possible. Until now, it was not precisely known when a paperjam was occurring between the support rolls, because the web tension measurement systems customarily used cannot detect a paper break. Thus, after a tension interruption is caused by the support roll and paper reel, the paper is further advanced. Now, if a paper jam occurs, the sealing body is shifted to the right or to the left by the bottom wall because of the accumulation of paper (or some other material web), and the winding device is capable of being stopped for safety reasons. Moreover, this has the advantage that further amassing of paper in the winding bed can be avoided.

In a preferred embodiment, the sealing body is movable along a plane which is sloped relative to a perpendicular mid-plane through the winding bed. In this case, the sealing body can be moved below the bottom wall in its movement such that the opening or gap freed becomes even larger. Thus, the risk of a paper or material web jam occurring decreases even further.

Here, it is preferable for the bottom wall to be sloped in the direction of the sealing body. If the bottom boundary wall of the pressure chamber has a slope and paper is collected in the pressure chamber, the "clog" will slide under the effect of gravity on the angled bottom plate in the direction of the sealing body. This movement usually occurs before any movement which is caused by the pressure of the collected paper. In the case of failure, the paper web will thus be able to move out of the pressure chamber at an earlier time.

It is also advantageous for a stationary seal to be arranged between the bottom wall and one support roll, such that the rotational direction of this support roll runs from the bottom wall to the winding bed. The possibility that a material web may jam between the stationary seal or sealing arrangement and the support roll is relatively low. As soon as a material web introduced into the pressure chamber comes into contact with the appropriate support roll, the web is again moved away from the seal due to friction between the material web and the support roll. The other support roll, which rotates such that its surface moves toward the moving sealing body, is more critical. If a material web or a material web clog is impelled by this support roll, the clog is capable of pushing the sealing body away such that the material will not collect in the pressure box.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

The invention is described in detail in the following with reference to preferred exemplary embodiments in conjunction with the drawings. They show.

DETAILED DESCRIPTION OF THE PRESENT INVENTION

Figure 1:
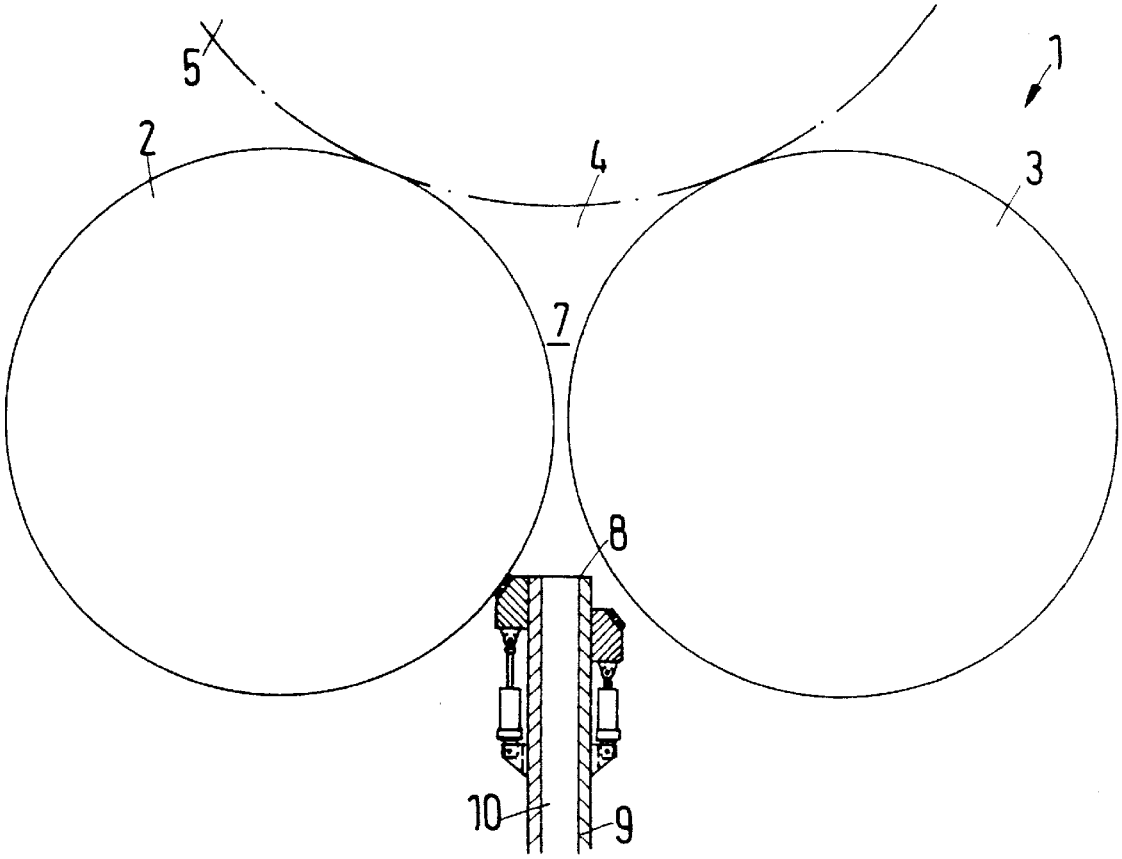
FIG. 1 is a schematic end view of a reel winding device.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A reel winding device 1 has two driven support rolls 2, 3, between which a winding bed 4 is formed. A winding reel 5 is positioned in the winding bed 4. This is used to wind a material web 6. The feeding of the material web 6 is not shown in detail in FIG. 1. Possible paths for the web are seen in the individual depictions of FIG. 2.

Figure 2A:
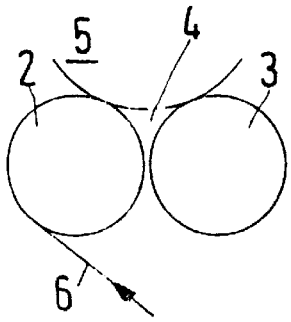
FIGS. 2*a,* 2*b,* and 2*c* depict different embodiments for feeding a material web to the winding device.

FIG. 2*a* shows that the material web 6 is fed in from the bottom right, passes approximately 180° around the left support roll 2, and then runs into the winding bed 4.

Figure 2B:
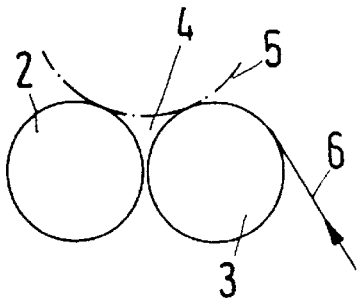

FIG. 2*b* shows a winding technique in which the material web is fed in from the bottom right and passes around the right support roll 3 at an angle of approximately 90° before it comes into contact with the winding reel 5.

Figure 2C:
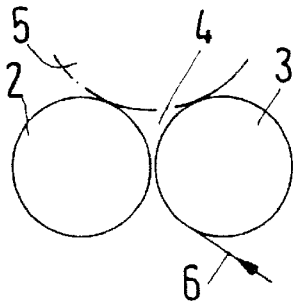

Finally, FIG. 2*c* shows the material web 6 being introduced into the space between the two carrier rolls 2, 3 from the bottom, passing around the right support roll 3 at an angle of approximately 150°, and then being wound onto the winding reel 5.

Of course, it is possible to also orient the web paths in a mirror image relative to a plane which is positioned vertically between the two support rolls 2, 3.

The reel weight of the winding reel 5 increases as the diameter of the reel increases. Thus, the linear support forces in the nips between the winding reel 5 and the support rolls 2, 3 increase. However, the linear support force is one of the factors which affect the winding tightness of the winding reel 5. In the winding of a paper web (and the same applies for comparable webs, in particular plastic films or metal foils), it is desirable to obtain a winding tightness pattern in which the winding tightness decreases from the inside toward the outside.

In order to reduce the linear support forces, a compressed air cushion is generated in the winding bed 4 and this compressed air cushion supports the winding reel 5 and accordingly reduces the linear support forces on the support rolls 2, 3.

In order to be able to generate this compressed air cushion in the winding bed, a pressure chamber 7 is provided which is bounded on the left by one support roll 2, on the right by the other support roll 3, and at the top by the winding reel 5. Reel end boundaries are not shown here but are present.

On the side of the pressure chamber 7 opposite the winding bed, a bottom wall 8, which is structured as an air box 9, is provided. The air box 9 also has a supply channel 10 through which the compressed air can be fed into the pressure chamber 7.

Figure 3:
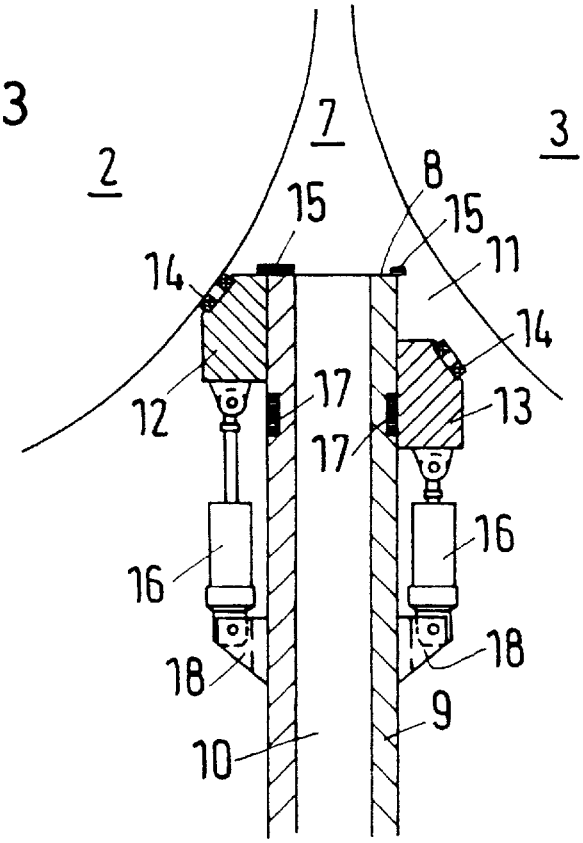
FIG. 3 is an enlarged depiction of a portion of FIG. 1.

As shown in FIG. 3, a gap 11 is present between the air box 9 and the support rolls 2, 3. To close this gap 11, sealing bodies 12, 13 are provided, which are movable perpendicular to the top of the bottom wall 8. The sealing body 12 is shown in its farthest extended position while the sealing body 13 is shown in its farthest retracted position.

Each sealing body 12 or 13 has, on its side facing the respective support roll 2, 3, a sealing edge 14, which cooperates with the respective peripheral surface of the support roll 2, 3. To limit the farthest extended position of the sealing bodies 12 and 13, a stop 15 may be provided. The stop is set such that a small gap forms between the sealing edge 14 and the support roll 2, 3. Thus, the seal is made without contact. Naturally, the stop 15 may also be disposed at a different position.

The sealing bodies 12, 13 are pushed or moved by linear operating positioning motors 16 in the direction of the support rolls 2, 3 until they come into contact with the stop 15. The force applied by the respective positioning motor 16 is only great enough to balance the weight of the respective sealing body 12 itself and additional forces acting on the sealing body 12 in the direction of gravity. An example of such additional forces are those applied by the pressure in the pressure chamber 7. If, for whatever reason, a break in the material web 6 occurs in the winding bed 4, the material web 6 advances farther and does not wind onto the winding reel 5. Then a paper clog develops in the winding bed and this clog advances into the pressure chamber 7, where the clog presses against one of the two sealing bodies 12, 13. The increased force caused by this clog is sufficient to shift the sealing body into the position shown for the sealing body 13, thus creating the gap 11, through which the material web 6 can escape from the pressure chamber 7. Consequently, the danger of a web break resulting in greater damage is minimal.

Each positioning motor 16 operates with a force independent of path length. Thus, if either sealing body 12 or 13 is pressed downwardly, no greater force is required with increased pressing. As soon as a malfunction occurs, the material web 6 presses against the sealing body 13, thereby causing the greatest possible gap 11 to develop. However, auxiliary energy such as compressed air, hydraulic pressure, or electric current must then be made available to the positioning motor.

In order to detect a failure as quickly as possible, a sensor 17 is provided for each sealing body 12 or 13 in order to determine a position change in the sealing body. The sensor 17 can then emit a signal which stops the winding device 1 and causes the material web to be cut off. During operation, a web break in the winding bed 4 cannot be detected by determining the tension upstream from the winding device. When a malfunction occurs, there is a high probability that one of the sealing bodies 12 or 13 will be pressed downwardly, thus making it possible to detect a failure with the same high probability.

FIG. 3 shows that each sealing body 12 or 13 is connected to the air box 9 only at the bottom end of each of the positioning motors 16. The sealing bodies are supported on projections 18. While not shown in detail, linear guidance for each sealing bodies 12 and 13 is provided on the outside wall of the air box 9.

Figure 4:
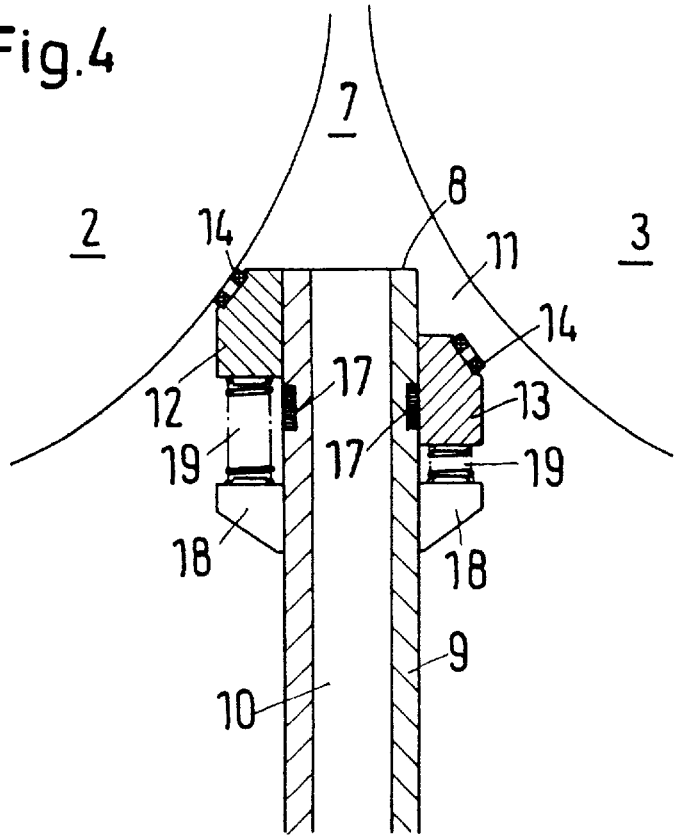
FIG. 4 is an alternative embodiment to FIG. 3.

FIG. 4 shows an alternative embodiment in which the same components are assigned the same reference characters. In this embodiment, the positioning motors 16 have been replaced by springs 19. The springs 19 are proportioned such that when the sealing body 12 is extended as shown on the left in FIG. 4, an equilibrium state exists. The forces on the sealing body 12 are virtually balanced, the spring 19 acting against the weight of the sealing body 12 itself and the pressure forces of the compressed air. In the exemplary embodiment of FIG. 4, the sealing bodies 12 and 13 are also not driven against stops 15. Rather, each sealing edge 14 of each sealing body contacts its respective support roll 2 or 3. Since, as mentioned, there is virtual equilibrium of forces, the pressing force of each sealing edge 14 against its respective support roll 2 or 3 is very slight.

When a malfunction occurs with this design, the incoming paper web encounters a sealing body, e.g., the sealing body 13, and pushes it downwardly against the force of the spring 19 such that the gap 11 is formed and the paper web can be pushed out again. Thus, the operation is similar to that of the embodiment according to FIG. 3.

Figure 5:
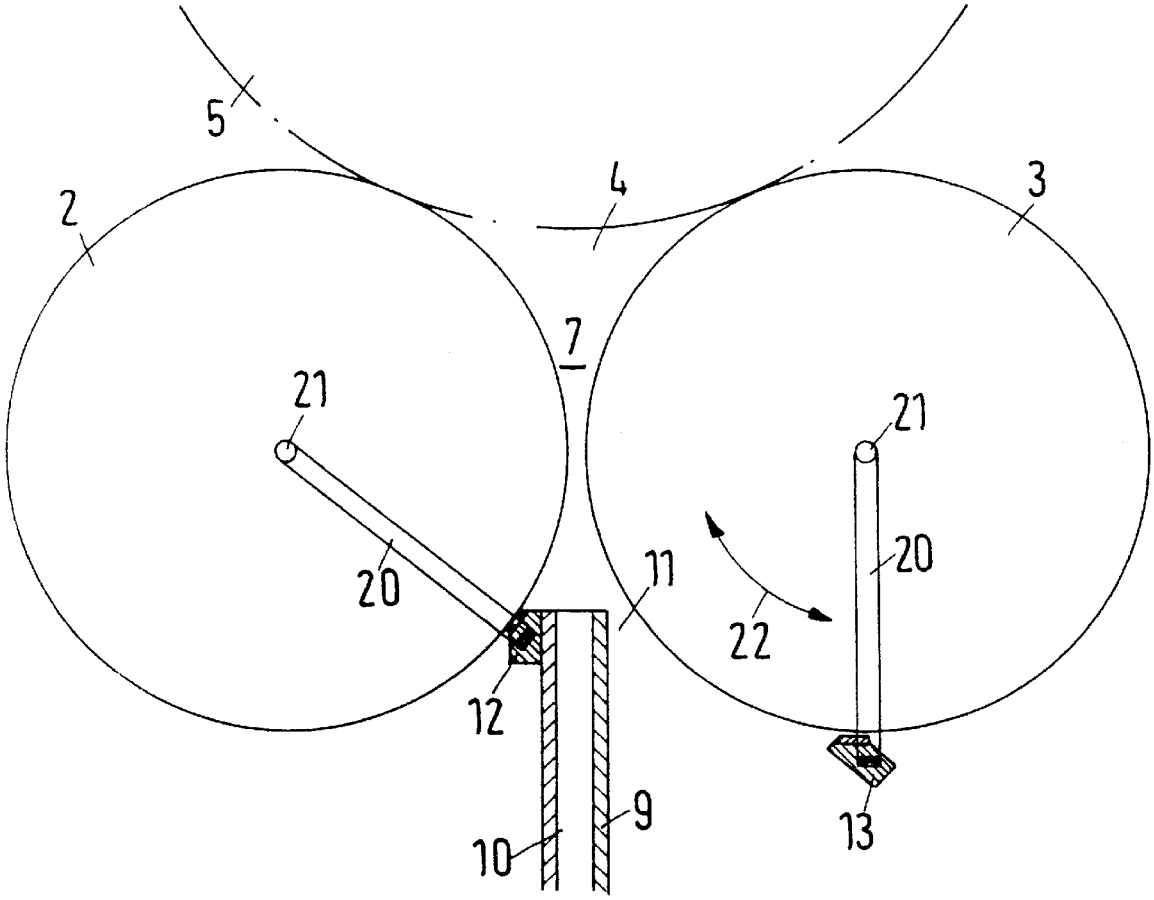
FIG. 5 is an alternative embodiment to FIG. 1.

FIG. 5 shows another embodiment. In the embodiments of FIGS. 1, 3, and 4, the sealing bodies 12 are shifted linearly along the outside wall of the air box 9. In the embodiment of FIG. 5, the sealing bodies 12 and 13 are attached to levers 20, which are pivotable around the axis of rotation 21 of the support rolls 2 and 3. The levers 20 are pivotable in the direction of the double arrow 22 from an operating position shown on the left in FIG. 5, in which the gap 11 between the air box 9 and the support roll 2 is closed and the position shown on the right in FIG. 5 in which the gap 11 is open. The sealing bodies 12 and 13 are rigidly attached to the free ends of the lever 20 and upon pivoting, the sealing bodies do not change their alignment with the support rolls 2 and 3. Accordingly, the sealing bodies "fit" precisely in the gaps 11 when they are pivoted into the position as shown in FIG. 5 on the left.

The embodiment of FIG. 5 is particularly suitable for web paths such as those shown in FIGS. 2*a* and 2*b*.

With respect to FIGS. 1 and 5, the paths of movement of the sealing bodies 12 and 13 exhibit in each case certain limiting options. Certainly, the sealing bodies 12, 13 may be moved on other paths which run between these two limits. However, the paths of movements of the embodiments of FIGS. 1 and 5 are advantageous since it is possible to use elements already present in the winding device 1 to support the sealing bodies 12 and 13.

Figure 6:
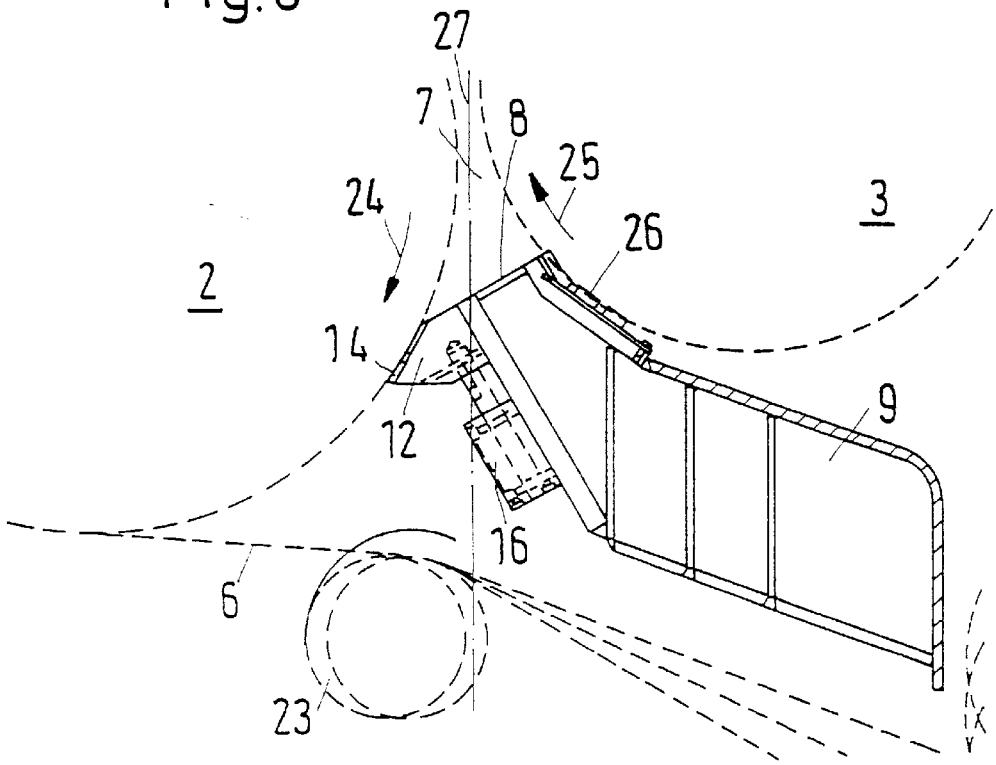
FIG. 6 is another alternative embodiment to FIG. 1.
Figure 7:
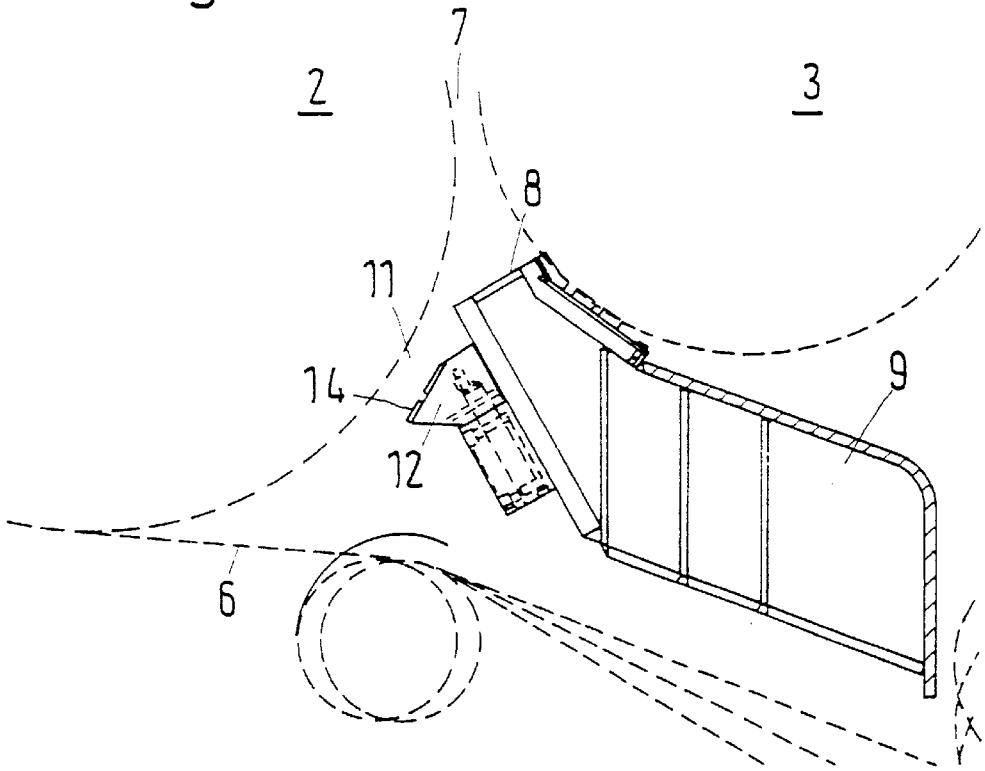
FIG. 7 is a depiction of FIG. 6 with the sealing body out of contact with the support roll.

FIGS. 6 and 7 show another embodiment of a reel winding device, which differs from those previously shown in that the two support rolls and 3 have different diameters. Also, their rotational axes may be positioned at different heights.

Another difference in the embodiments of FIGS. 6 and 7 is that only one movable sealing body 12 is provided which cooperates with the support roll 2. Here, it should be especially noted that the material web 6, which is guided over a broad drawing roll 23, arrives first on support roll 2 which rotates in the direction of an arrow 24. The other support roll 3 has the same direction of rotation. With respect to the pressure chamber 7, the movement of the surface of the support roll 3 is exactly opposite to that of the support roll 2, which is shown by an arrow 25.

A stationary sealing arrangement 26 which cooperates with the support roll 3 is attached to the air box 9.

The bottom wall 8 is sloped in the direction of the movable sealing body 12. The bottom wall 8 thus encloses an angle which is less than 90° with a plane 27 which forms the perpendicular mid-plane of the winding bed.

The direction of movement of the movable sealing body 12 is no longer parallel to plane 27 but rather is sloped at an angle in the range between about 15° and about 45° relative to this plane 27. As can be seen from FIG. 7, when the sealing body 12 retracts, a relatively large gap 11 develops between the support roll 2 and the sealing edge 14, such that in the case of a malfunction the material web 6 introduced into the pressure chamber 7 is run out more expeditiously.

The possibility that the material web 6 will enter the sealing zone between the support roll 3 and the sealing arrangement 26 is relatively low. As soon as the material web comes into contact with the surface of the support roll 3, the material web is pushed back or transported away in the direction of the arrow 25.

However, if in a malfunction the material web reaches the bottom wall 8, the web will slide downwardly under the effect of gravity onto the movable sealing body and be driven by the support roll 2 in the direction of the arrow 24. Entrapment between the seal 14 and the support roll 2 cannot occur since the sealing body 12 is pushed back by the material web.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

What is claimed:

1. A reel winding device comprising:

a winding bed composed of two support rolls that form side walls of a pressure chamber;

a bottom wall fixed against movement; and at least one sealing body movable relative to the bottom wall, wherein the at least one movable sealing body is disposed between the bottom wall and at least one of the two support rolls and is positioned in the direction of a sealing position with at least one of the two support rolls, such that a small force resulting from a clog advancing into the pressure chamber is sufficient to move the at least one movable sealing body away from the sealing position, when the clog in the pressure chamber presses against the at least one movable sealing body.

2. The reel winding device of claim 1, the at least one movable sealing body being adapted to move in a direction away from the at least one of the two support rolls.

3. The reel winding device of claim 1, further comprising a spring for positioning the at least one movable sealing body.

4. The reel winding device of claim 1, further comprising a motor for positioning the at least one movable sealing body.

5. The reel winding device of claim 1, further comprising a stop, the at least one movable sealing body working in cooperation with the stop.

6. The reel winding device of claim 1, wherein the at least one movable sealing body contacting the at least one of the two support rolls comprises a sealing edge.

7. The reel winding device of claim 6, the sealing edge being movable along a plane which is sloped relative to a perpendicular mid-plane through the winding bed.

8. The reel winding device of claim 7, the bottom wall being sloped in the direction toward the at least one movable sealing body.

9. The reel winding device of claim 7, further comprising a stationary seal disposed between the bottom wall and the at least one of the two support rolls, wherein the at least one of the two support rolls is rotatable in a direction from the bottom wall to the winding bed.

10. The reel winding device of claim 1, wherein a sum of a weight of the at least one movable sealing body and a force resulting from a compressed air load is substantially in equilibrium with a force positioning the at least one movable sealing body in the sealing position.

11. The reel winding device of claim 1, further comprising an air box to supply compressed air to the pressure chamber, the air box comprising the bottom wall.

12. A reel winding device comprising:

a winding bed composed of two support rolls that form side walls of a pressure chamber;

a bottom wall;

at least one sealing body movable relative to the bottom wall, wherein the at least one movable sealing body is disposed between the bottom wall and at least one of the two support rolls, is positioned in the direction of a sealing position with the at least one of the two support rolls and is adapted to move in a direction away from the at least one of the two support rolls;

a spring for positioning the at least one movable sealing body; and a position sensor, the at least one movable sealing body working in cooperation with the position sensor, wherein the position sensor emits an error signal in the event of a displacement of the at least one movable sealing body away from the at least one of the two support rolls.

13. A reel winding device comprising:

a winding bed composed of two support rolls that form side walls of a pressure chamber;

a bottom wall;

at least one sealing body movable relative to the bottom wall, wherein the at least one movable sealing body is disposed between the bottom wall and at least one of the two support rolls, is positioned in the direction of a sealing position, and is adapted to move in a direction away from the at least one of the two support rolls;

a motor for positioning the at least one movable body; and a position sensor, the at least one movable sealing body working in cooperation with the position sensor, wherein the position sensor emits an error signal in the event of a displacement of the at least one movable sealing body away from the at least one of the two support rolls.

14. A reel winding device comprising:

a winding bed composed of two support rolls that form side walls of a pressure chamber;

a bottom wall;

at least one sealing body movable relative to the bottom wall, wherein the at least one movable sealing body is disposed between the bottom wall and at least one of the two support rolls, is positioned in the direction of a sealing position, and is adapted to move in a direction away from the at least one of the two support rolls;

a stop, the at least one movable sealing body working in cooperation with the stop; and a position sensor, the at least one movable sealing body working in cooperation with the position sensor, wherein the position sensor emits an error signal in the event of a displacement of the at least one movable sealing body away from the stop.

15. A reel winding device comprising:

a winding bed composed of two support rolls that form side walls of a pressure chamber;

a bottom wall;

at least one sealing body movable relative to the bottom wall, wherein the at least one movable sealing body is disposed between the bottom wall and at least one of the two support rolls, is positioned in the direction of a sealing position, and is adapted to move in a direction away from the at least one of the two support rolls; and a position sensor, the at least one movable sealing body working in cooperation with the position sensor, wherein the position sensor emits an error signal in the event of a displacement of the at least one movable sealing body away from the at least one of the two support rolls, wherein a sum of a weight of the at least one movable sealing body and a force resulting from a compressed air load is substantially equal to a force positioning the at least one movable sealing body in the sealing position.

16. A reel winding device comprising:

a winding bed composed of two support rolls that form side walls of a pressure chamber;

a bottom wall fixed against movement; and at least one sealing body movable relative to the bottom wall, wherein the at least one movable sealing body is disposed between the bottom wall and at least one of the two support rolls and is positioned in the direction of a sealing position with at least one of the two support rolls, and wherein, in the sealing position, an equilibrium state exists on the at least one movable sealing body whereby a sum of a weight of the at least one movable sealing body and a force resulting from a compressed air load is substantially equal to a force positioning the at least one movable sealing body in the sealing position.

17. A process for supporting a winding reel on an apparatus that includes a a winding bed formed by two support rolls that form side walls of a pressure chamber, a bottom wall fixed against movement, and at least one sealing body movable relative to the fixed bottom wall, wherein the at least one movable sealing body is disposed between the bottom wall and at least one of the two support rolls, the process comprising:

rotating the winding reel;

rotating the two support rolls;

positioning the at least one movable sealing body in a vicinity of a circumferential surface of at least one of the two support rolls; and moving the at least one movable sealing body relative to the bottom wall into a sealing position with the at least one of the two support rolls such that a small force resulting from a clog advancing into the pressure chamber is sufficient to move the at least one movable sealing body away from the sealing position, when the clog in the pressure chamber presses against the at least one movable sealing body.

18. The process of claim 17, further comprising moving the at least one movable sealing body in a direction away from the at least one of the two support rolls.

19. The process of claim 18, wherein the moving the at least one movable sealing body comprises moving the at least one movable sealing body with a spring.

20. The process of claim 18, wherein the moving the at least one movable sealing body comprises moving the at least one movable sealing body with a motor.

21. The process of claim 17, wherein movement of the at least one movable sealing body is stopped by a stop.

22. The process of claim 17, wherein the at least one movable sealing body contacting the at least one of the two support rolls comprises a sealing edge.

23. The process of claim 22, further comprising moving the sealing edge along a plane which is sloped relative to a perpendicular mid-plane through the winding bed.

24. The process of claim 22, wherein the bottom wall is sloped in the direction toward the sealing edge.

25. The process of claim 23, further comprising forming a stationary seal between the bottom wall and the at least one of the two support rolls, and wherein the at least one of the two support rolls rotates in a direction from the bottom wall to the winding bed.

26. The process of claim 17, wherein a sum of a weight of the at least one movable sealing body and a force resulting from a compressed air load is substantially in equilibrium with a force positioning the at least one movable sealing body in the sealing position.

27. The process of claim 17, wherein the apparatus further includes an air box comprising the bottom wall and wherein the process further comprises supplying compressed air from the air box to the pressure chamber.

28. A process for supporting a winding reel on an apparatus that includes a a winding bed formed by two support rolls that form side walls of a pressure chamber, a bottom wall, a position sensor on the bottom wall, and at least one sealing body movable relative to the bottom wall, wherein the at least one movable sealing body is disposed between the bottom wall and at least one of the two support rolls, the process comprising:

rotating the winding reel;

rotating the two support rolls;

positioning the at least one movable sealing body in a vicinity of a circumferential surface of the at least one of the two support rolls; and moving the at least one movable sealing body into a sealing position with the at least one of the two support rolls, the moving being performed by a spring; wherein the position sensor emits an error signal in the event of a displacement of the at least one movable sealable body away from the at least one of the two support rolls.

29. A process for supporting a winding reel on an apparatus that includes a a winding bed formed by two support rolls that form side walls of a pressure chamber, a bottom wall, a position sensor located on the bottom wall, and at least one sealing body movable relative to the bottom wall, wherein the at least one movable sealing body is disposed between the bottom wall and at least one of the two support rolls, the process comprising:

rotating the winding reel;

rotating the two support rolls;

positioning the at least one movable sealing body in a vicinity of a circumferential surface of the at least one of the two support rolls; and moving the at least one movable sealing body into a sealing position with the at least one of the two support rolls, the moving being performed by a motor;

wherein the position sensor emits an error signal in the event of a displacement of the at least one movable sealable body away from the at least one of the two support rolls.

30. A process for supporting a winding reel on an apparatus that includes a a winding bed formed by two support rolls that form side walls of a pressure chamber, a bottom wall, a stop located on the bottom wall, a position sensor located on the bottom wall, and at least one sealing body movable relative to the bottom wall, wherein the at least one movable sealing body is disposed between the bottom wall and at least one of the two support rolls the process comprising:

rotating the winding reel;

rotating the two support rolls;

positioning the at least one movable sealing body in a vicinity of a circumferential surface of the at least one of the two support rolls; and moving the at least one movable sealing body into a sealing position with the at least one of the two support rolls; wherein the at least one movable sealing body is stopped by the stop and wherein the position sensor emits an error signal in the event of a displacement of the at least one movable sealable body away from the at least one of the two support rolls.

31. A process for supporting a winding reel on an apparatus that includes a a winding bed formed by two support rolls that form side walls of a pressure chamber, and a bottom wall, and at least one sealing body movable relative to the bottom wall, wherein the at least one movable sealing body is disposed between the bottom wall and at least one of the two support rolls, the process comprising:

rotating the winding reel;

rotating the two support rolls;

positioning the at least one movable sealing body in a vicinity of a circumferential surface of the at least one of the two support rolls; and moving the at least one movable sealing body into a sealing position;

wherein a sum of a weight of the at least one movable sealing body and a force resulting from a compressed air load is substantially equal to a force positioning the at least one movable sealing body in the sealing position, and wherein the position sensor emits an error signal in the event of a displacement of the at least one movable sealing body from the at least one of the two support rolls.

32. A process for supporting a winding reel on an apparatus that includes a a winding bed formed by two support rolls that form side walls of a pressure chamber, a bottom wall fixed against movement, and at least one sealing body movable relative to the fixed bottom wall, wherein the at least one movable sealing body is disposed between the bottom wall and at least one of the two support rolls, the process comprising:

rotating the winding reel;

rotating the two support rolls;

positioning the at least one movable sealing body in a vicinity of a circumferential surface of at least one of the two support rolls; and moving the at least one movable sealing body relative to the bottom wall into a sealing position with the at least one of the two support rolls, wherein, in the sealing position, an equilibrium state exists on the at least one movable sealing body whereby a sum of a weight of the at least one movable sealing body and a force resulting from a compressed air load is substantially equal to a force positioning the at least one movable sealing body in the sealing position.

* * * * *

UNITED STATES PATENT AND TRADEMARK OFFICE

CERTIFICATE OF CORRECTION

PATENT NO. : 6,360,983 B1
DATED : March 26, 2002
INVENTOR(S) : Rainer Pumpe

It is certified that error appears in the above-identified patent and that said Letters Patent is hereby corrected as shown below:

Title page,
Item [73], Assignee: "Voith Sulzer Sulzer Papiertechnik Patent GmbH, Heidenheim (DE)" should be -- Voith Sulzer Papiertechnik Patent GmbH, Heidenheim (DE) --

Signed and Sealed this

Fourth Day of June, 2002

*Attest:*

*Attesting Officer*

JAMES E. ROGAN
*Director of the United States Patent and Trademark Office*